US005643057A

United States Patent [19]

Isaacson

[11] Patent Number: 5,643,057

[45] Date of Patent: Jul. 1, 1997

[54] METHOD AND APPARATUS FOR UNIFORMLY TEXTURIZING OBJECTS USING ABRASIVE BLASTING

[75] Inventor: Larry Z. Isaacson, Atlanta, Ga.

[73] Assignee: Masonry Processes, Inc., Atlanta, Ga.

[21] Appl. No.: 491,525

[22] Filed: Jun. 16, 1995

[51] Int. Cl.[6] ..... B24C 3/08; B24C 3/18

[52] U.S. Cl. ..... 451/81; 451/80

[58] Field of Search ..... 451/1, 81, 29, 451/30, 31, 38, 87, 91, 80, 83, 82, 78, 79, 89

[56] References Cited

U.S. PATENT DOCUMENTS

| | | | |
|---|---|---|---|
| 612,232 | 10/1898 | Chambers et al. | 451/81 |
| 843,082 | 2/1907 | Gale | 451/79 |
| 2,195,810 | 4/1940 | Bower | 451/81 |
| 4,897,969 | 2/1990 | Balhorn | 51/418 |
| 5,182,882 | 2/1993 | Brodene et al. | 451/81 |
| 5,360,486 | 11/1994 | Elliott | 451/81 |
| 5,417,608 | 5/1995 | Elliott | 451/81 |
| 5,507,683 | 4/1996 | Holm et al. | 451/81 |
| 5,512,005 | 4/1996 | Gulling | 451/81 |
| 5,533,922 | 7/1996 | Yamaharu | 451/81 |

*Primary Examiner*—James G. Smith
*Assistant Examiner*—Derris H. Banks
*Attorney, Agent, or Firm*—Needle & Rosenberg, P.C.

[57] ABSTRACT

A method and apparatus for creating a uniform texture on the face of an object using at least one sandblasting nozzle. Each nozzle is disposed at a placement distance from the face of the object based on factors including the relative motion therebetween, the size of the nozzle, the air pressure feeding particle through the discharge end of the nozzle, the material composition of the object, and the desired appearance of the face of the object after texturizing. The nozzle discharges blast media to uniformly texturize the face of the object to obtain the desired appearance.

23 Claims, 1 Drawing Sheet

METHOD AND APPARATUS FOR UNIFORMLY TEXTURIZING OBJECTS USING ABRASIVE BLASTING

BACKGROUND OF THE INVENTION

1. Field of the Invention

This invention relates to creating a uniform texture on the face of an object. More particularly, the invention relates to an improved method and apparatus for abrasive blasting the face of an object to give it a desired uniform appearance.

2. Background Art

Abrasive blasting, commonly referred to as sandblasting, has been a method for cleaning and deburring objects for years. Recently, the concrete industry has given this technique increased attention for other purposes, namely, as a method to prepare attractive surfaces for use in the construction industry. An example is texturized concrete blocks.

An important consideration in preparing a texturized surface is that the treated face have a uniform appearance. There have been attempts to achieve this objective in the prior art, but the processes developed have been ineffective or wasteful. For example, construction of the airport in San Antonio, Tex. used concrete blocks that were individually blasted by operators. That is, an operator manually moved a sandblasting apparatus back and forth across the face of each concrete block before its installation. This method of texturing a surface is expensive because it is labor intensive. It also wastes materials since little, if any, sand can be reused. In addition, the results are not uniform from block to block. Variations result from differences that exist between individual operators as well as variances in each operator's actions from block to block.

Another technique to texturize the face of an object is taught in Balhorn, U.S. Pat. No. 4,897,969. Balhorn relies on an automated process in which the object to be sandblasted moves via a conveyor through a sandblasting spray. However, to prevent non-uniformity of the surface caused by the concentration of particles in the central local, Balhorn requires a baffle plate to block the concentrated particle region. The concentration of blast media decreases as the radial distance from the center of the spray effluent is increased. The baffle blocks the concentrated area of particulant in the central area and only allows a portion of the less concentrated effluent to spray the object. Balhorn teaches that the baffle which blocks the concentrated particulate spray aids in achieving a uniformly textured face.

Balhorn, however, has drawbacks. A high percentage of the blast media is wasted because the baffle blocks the concentrated spray from the central area of the nozzle and only allows periphery particles to contact the object. Additionally, the nozzle has to be placed at a considerable distance from the face of the object to achieve a uniform result. A distance of over five feet is common, but the area of uniformity is still restricted.

SUMMARY OF THE INVENTION

The above disadvantages of the prior art are overcome by the present invention which provides an improved method and apparatus for uniformly texturing an object. The present invention relies upon variables, including, for example, speed of the relative motion between the nozzles and object, size of the nozzles, placement of the nozzles, feed pressure of the blast media, and the like. These factors affect the texturization of an object, but the prior art has not addressed them or their interrelationship to each other. By considering these factors together, the resultant texturized face of the object is uniform to the naked eye. These types of considerations have never been interrelated so as to create a uniform texturized surface on the face of an object.

The method of the present invention for texturing the face of an object entails the steps of calculating a placement distance to dispose the discharge end of at least one sandblasting nozzle from the face of the object, disposing the discharge end of the nozzle at that calculated placement distance, moving either the object and/or the nozzle relative to the other, and spraying the face of the object with particles from the discharge end of the nozzle so as to uniformly texturize the face of the object.

The present invention also provides an apparatus for texturizing the face of an object which can have at least one sandblasting nozzle disposed at a placement distance from the face of the object, a means for moving the object relative to the nozzle, and a plurality of particles operatively connected to the nozzle. The particles are emitted from the nozzle at a particle feed rate for a predetermined air pressure so that the face of the object is subjected to a spray of particles from the nozzle. The placement distance can be calculated based on the relative speed of movement of the object relative to the nozzle, the size of the nozzle, the air pressure feeding particles through the nozzle, the material composition of the object, and the desired appearance of the face of the object after texturizing.

The present invention can encompass one or more nozzles. For multiple nozzle applications, the preferred vertical distance separating each nozzle can be calculated as a function of the width of the apparent uniform etch of each nozzle.

The present invention advantageously creates a texturized uniform appearance on the face of the object. In contrast to the prior art, variations do not exist in the texturized face as a result of operator differences.

Another advantage of the present invention is alleviating the formation of a non-uniform etching pattern in the face of the object. This is achieved by interrelating the different variables that has an effect on the texturization of the face of the object. Based on these variables, the distance at which to place the discharge end of the nozzle relative to the face is determined so that the desired appearance results without non-uniform etching. Thus, no baffle plate or similar device is required in the present invention to achieve a uniform appearance in the face of the object. Accordingly, the blast media particles are not wasted as they strike the face of the object instead of a baffle.

Another advantage of the present invention is its increased rate of production. For a single nozzle operation, experimental tests have shown an increased output of over 15% as compared to Balhorn. Furthermore, the present invention teaches the use of multiple nozzles, as opposed to a single nozzle, which allows further increase in the production rate of the present invention.

Additionally, the present invention allows smaller diameter nozzles to be used and still achieve high production rates. This decreases the air and blast media requirements. Accordingly, blast media consumption per unit texturized is reduced.

Another advantages is that less space is required for the present invention compared to a conventional sandblasting apparatus.

Still another advantage of the present invention is that larger objects can be uniformly texturized, thereby increasing the potential utilization and efficiency of the process.

Other features and advantages of the invention will become apparent to those skilled in the art upon review of the following detailed description, claims, and drawings.

DETAILED DESCRIPTION OF THE INVENTION

Figure 1:
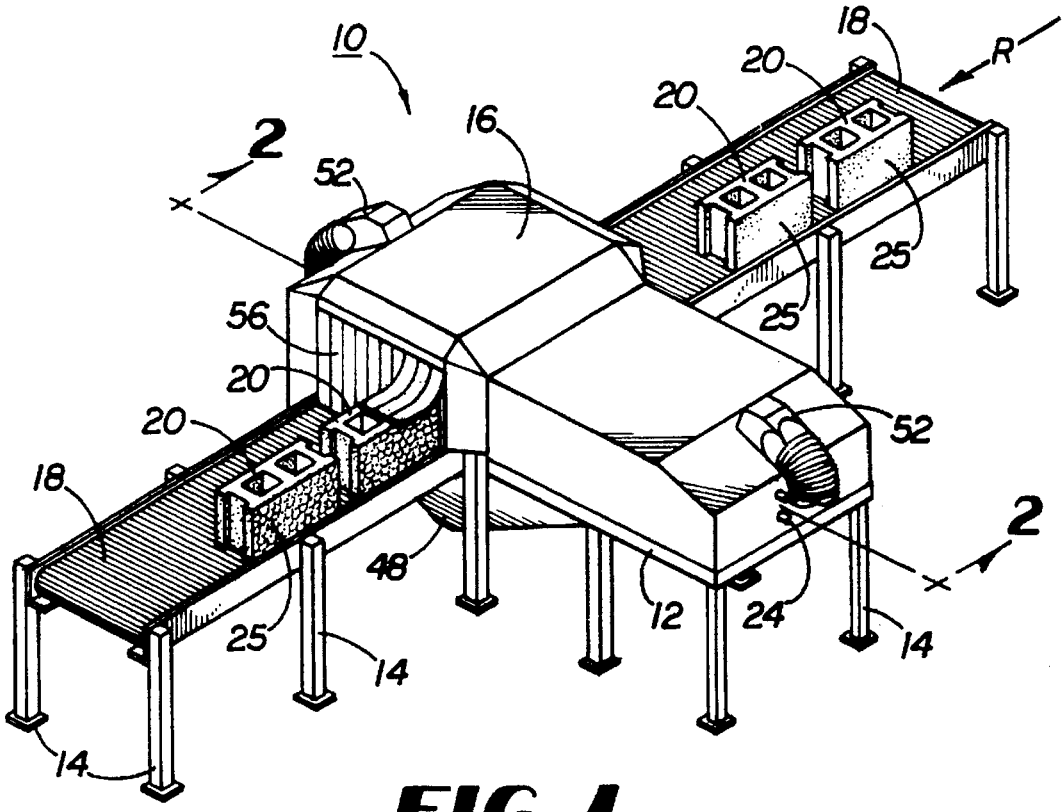
FIG. 1 is a perspective view of a sandblasting unit of the present invention.

The present invention is more particularly described in the following examples which are intended as illustrative only since numerous modifications and variations therein will be apparent to those skilled in the art.

As used in the specification and in the claims, "a" can mean one or more, depending upon the context in which it is used.

A sandblasting unit 10 to texturize the face 25 of an object 20 is shown in FIGS. I and 2. The sandblasting unit 10 includes a frame 12 with a plurality of legs 14. A housing 16 is mounted on the frame 12.

The sandblasting unit 10 for uniformly texturizing a face 25 of an object 20 comprises at least one sandblasting nozzle 23 having a diameter therein and a discharge end 22 disposed at a placement distance D from the face 25 of the object 20, means for moving a selected one of the object 20 or the nozzle 23 in front of the other, and a plurality of particles operatively connected to the nozzle 23, wherein the particles are emitted from the nozzle 23 at a particle feed rate for a predetermined air pressure, so that the face 25 of the object 20 is subjected to a spray 40 of particles from the nozzle 23 to obtain the desired appearance.

Figure 2:
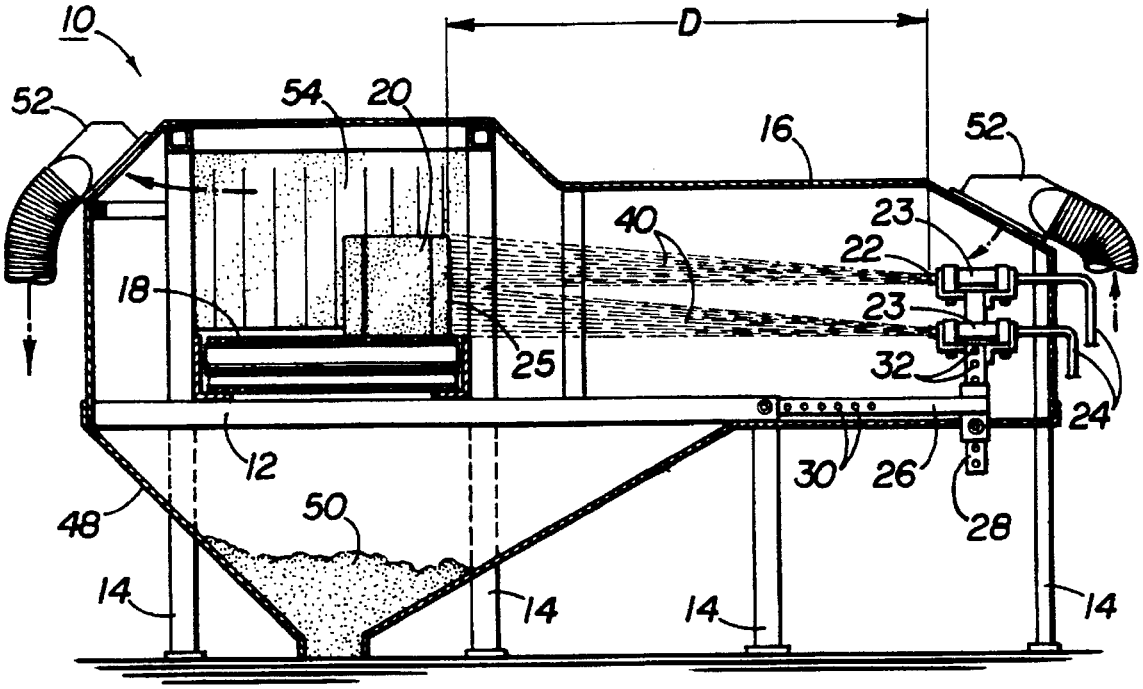
FIG. 2 is a sectional view taken along lines 2—2 of FIG. 1.

Still referring to FIGS. 1 and 2, the means to move the object 20 through the housing 16 of the unit 10 is a conveyor 18 which is mounted on the frame 12 and extends through the housing 16. The objects 20 to be sandblasted, such as concrete blocks, rest on the conveyor 18 and move through the housing 16.

As shown in FIG. 2, at least one sandblasting nozzle 23 is mounted within the housing 16. Each nozzle 23 is operatively connected to a source of sandblasting material via an inlet line 24, with each nozzle 23 emitting an adjustable spray 40 of sandblasting particles. The particles are fed through the inlet line 24 and out the discharge end 22 of the nozzle 23 by pressurized air. These particles strike the face 25 of the object 20 within the housing 16 with sufficient energy to texturize the face 25 of the object 20.

The sandblasting unit 10 can have at least two nozzles 23. Preferably, when two or more nozzles 23 are used, the nozzles 23 are the same type, the same size, and the discharge end 22 of each nozzle 23 is disposed equidistance from the face 25 of the object 20. The size of the nozzle 23 is determined by the smallest diameter within the nozzle 23. The discharge ends 22 of the nozzles 23 can be mounted in a vertical plane perpendicular to the relative movement of a selected one of the face 25 of the object 20 or the discharge end 22 of the nozzles 23 in front of the other.

The used sandblasting particles 50 fall by gravity. A collection trough 48 can be aligned to catch the used particles, from which the particles can be filtered and recirculated to the sandblasting nozzle 23 for reuse. Vents 52 can also be provided on the sandblasting unit 10 for suctioning away the waste material blasted from the concrete blocks or objects 20 as shown in FIG. 2 and collect in a dust collector (not shown). In this embodiment, the inlet is covered with a plurality of membrane strips 54 and an outlet also covered with membrane strips 56 which allow the passage of objects 20 to and from the interior of the unit 10. Alternative means are available to seal the inlet and the outlet. The frame 12 can also be covered with an energy absorbing material, such as rubber, within the housing 16 so as to minimize deflection of sandblasting particles.

The present invention also provides a method of uniformly texturizing an object 20 having at least one face 25. In particular, the method involves calculating a placement distance D to dispose the discharge end 22 of at least one sandblasting nozzle 23 from the face 25 of the object 20. The method then involves disposing the discharge end 22 of the nozzle 23 at the placement distance D. Next, the method entails moving a selected one of the face 25 of the object 20 or the discharge end 22 of the nozzle 23 in front of the other. Then, the method involves subjecting the face 25 of the object 20 to a spray 40 of particles from the discharge end 22 of the nozzle 23 generated by air pressure at a selected particle feed rate so as to uniformly texturize the face 25 of the object 20 to obtain the desired appearance.

This placement distance D is based on the relative speed of movement of either one of the object 20 or the nozzle 23, the size of the nozzle 23, the air pressure feeding particles through the discharge end 22 of the nozzle 23, the material composition of the object 20, and the desired appearance of the face 25 of the object 20 after texturizing.

In the preferred embodiment, the calculating step for the placement distance D utilizes the equation:

$$F=(E+10)(D)^{0.5}(R)(N^2)(P).$$

In this equation, P is the pressure of the air carrying the blast media measured as pounds per square inch gauge (psig). N is the size of the nozzle 23. Nozzle size is the smallest diameter within the nozzle 23 in sixteenths of an inch. For example, a number "8" nozzle 23 has a smallest diameter of 8/16, or ½, inch. R is the speed of movement, measured in inches per minute, of the object 20 relative to the nozzle 23. F is a rating which is based on the composition and hardness of the object 20 to be texturized. E is a rating for the desired appearance of the texturized face 25. The range for this rating is from 0 to 30, based on the appearance of the face 25 of the object 20 after being texturized. It is important to note that other equations are possible which would determine one or more of the following parameters N, D, R and P based on the parameters F and E being known.

The above equation is based on materials and equipment that are most commonly used in this art. As such, it relies on concrete product applications. Concrete is a heterogenous product which lends itself favorably to this invention. In a heterogenous material, the different components react differently to the blasting process, and this, in part, is what gives the etched object 20 an enhanced appearance. The exposure of aggregate within a cement matrix, the matrix itself capable of being colored, when done uniformly, can present a pleasant design and architectural effect.

The present invention can also be used on a non-heterogenous product. The result is that the object has a simple matte or dull finish. The equation remains the same for non-heterogenous objects as for heterogenous products.

The above equation describes one embodiment of the present invention. Many variables can alter this equation. Variations among individual sand blasting units 10 could affect the resultant equation. Small portable blast machines were used in part of the research. However, a stationary blast machine, Big Clem Bulk Abrasive Machine, Model 120-S, manufactured by Clemco Industries, 1 Cable Car Drive, Washington, Mo., 63090, was mainly used in the examples discussed below. This machine had fifty feet of flexible hose having a 1.25 inch inner diameter, a one inch pinch tube fully open, and a 12,000 pound pot equipped with multiple outlets. Results may be different with other brands or types of machines, or even between individual models of the same equipment. For example, different hose lengths, different hose diameters, and different settings on the pinch tubes can cause variations.

It is contemplated that calculation of the placement distance D is not restricted to these considerations discussed or limited from incorporating other factors. In its most fundamental terms, experiments have shown that a relationship exists between the air pressure feeding the spray 40 and the speed at which the object 20 passes through the spray 40 of particles. The higher the pressure, the less time that the target has to be subjected to the spray 40 to obtain the desired texturized appearance. If the pressure is too high for the speed of the object 20, grooves can result in the face 25 of the object 20. Conversely, if the pressure is too low, then not enough etching occurs to produce a satisfactory product.

Additionally, some factors can be considered as a different variable but involve the same consideration. For example, the air pressure feeding the particles through the discharge end 22 of the nozzle 23 can be represented as the average velocity of the particles or, alternatively, the average force of the particles striking the face 25 of the object 20.

Other changes could also vary the resultant equation. For example, the above equation is based on the use of a long venturi nozzle. If another type of nozzle is used, it may alter the specific relationship of terms in the equation, but probably not alter the parameters used to determine the placement distance D. Examples of other types of nozzles include short venturi nozzles, long and short straight barrel nozzles, double venturi nozzles, vented nozzles, and the like. The resulting equation for this and any other change would best be determined by performing test runs, collecting data regarding values of the above-cited parameters, and determining the relationship of the parameters.

The size of the venturi nozzles used in the experimental results discussed below ranged in size from 3/16" diameter to ½" diameter. The smaller 3/16" venturi nozzle, however, did not give good results with the larger abrasive material, such as Grade 2 silica sand. Nozzle sizes of 4/16" or greater are preferred. Tests with non-venturi nozzles showed that they behaved similarly to those performed with venturi nozzles. As discussed above, a non-venturi nozzle is satisfactory for the present invention but the relationship of the parameters may change in the above equation.

Although not an explicit factor, the type of abrasive material can affect the relationship of the parameters. Different types of abrasive material as well as grit sizes have an effect on the type of etch and the efficiency of obtaining a satisfactory etch. Silica sand is presently preferred; however, no restrictions are placed on the abrasive media that can be used. Examples include steel shot, glassbeads, industrial garnet, flint, copper and nickel slags, aluminum oxide, and the like.

Grade 2 silica sand was used in determining the above equation, but similar equations will develop with other media. The table below defines different grades of silica sand.

| GRADE | RETAINED ON MESH NUMBER | | | | | | | | | | | |
|---|---|---|---|---|---|---|---|---|---|---|---|---|
| NUMBER | 4 | 6 | 12 | 20 | 30 | 40 | 50 | 70 | 100 | 140 | 200 | Pan |
| 00 | | | | | 15 | 45 | 27 | 13 | | | | |
| 00-N | | | | 3 | 56 | 30 | 8 | 3 | | | | |
| 0 | | | | 49 | 42 | 9 | | | | | | |
| 1 | | | | 86 | 10 | 4 | | | | | | |
| 2 | | | 41 | 57 | 2 | | | | | | | |
| 3 | | 5 | 91 | 4 | | | | | | | | |

Tests have shown Grade 2 to be the best for texturizing an object 20 and that the results deteriorate as the grade number decreases, e.g., Grade 1 is good, Grade 0 marginal, and Grade 00 is poor. Silica sand used should be Grade 0 or greater.

The preferred range of air pressure for carrying the blast media is 40 to 90 psig. Pressures need to be above 35 psig for the nozzles 23 to function properly with silica sand.

There is no preferred speed of relative motion between each nozzle 23 and the face 25 of the object 20. However, it is advantageous to use a faster speed to achieve a greater production rate. As shown in FIG. 1, the moving means is a conveyor 18 for the object 20. The moving means may likewise be a slide system that moves the nozzles 23 relative to the object 20. Still another embodiment is a moving means in which the nozzle 23 and the object 20 both move relative to the other.

The parameter F, a constant for any particular lot of material, relates to both the hardness and composition of the object 20. It is determined empirically for each individual target. This factor varies for different compositions of materials and for different hardness for a type of material. For example, in a product produced from cement and aggregate, such as concrete block or concrete pavers, the matrix continues to harden over long periods of time. Specifically, the cement has a different hardness for the amount of time from when curing is initiated. This is because cement cures asymptotically throughout a period of years. Thus, the F changes significantly during this time period. Within short time frames, however, F will stay relatively constant for a production lot of material.

An independent test was developed that provides a measurement that relates to F used in the equation. The test entails placing a sample of the lot of material at a distance of forty inches from the discharge end 22 of a number 5 long venturi nozzle and then subjecting the sample to a spray of blast media of the type to be used in the production run. The spray continues for ten seconds at a pressure of 40 psig. The approximate value of F is determined by measuring the radial distance, in inches, from the center point of abrasive impact to a point where a satisfactory etch or texture exists. This distance is an indication of the value of F, though it would require an appropriate conversion factor for it to be used in the equation in the calculating step. This indication of F is imprecise because it is difficult to determine the exact radial distance because of the relatively small pattern and its constantly changing character. It is also hard to control accurately the duration of the blast. Thus, a more exact value of F is determined by trial runs using a moving object 20. The approximate F also allows predetermining settings for obtaining E values that are desired in the trial runs. This refined value of F is used in the equation.

Test runs on materials produced by the E. P. Henry Corporation, 201 Park Avenue, Woodbury, N.J., 08096 for F are as follows:

| Mix ID: | No. 55 | Rustic Brown | Waylite | Waylite |
|---|---|---|---|---|
| Approximate age of unit: | 6 months | 7 months | 1 day | 3 days |
| "F" Value: | 7.4 | 5.9 | 9.8 | 7.6 |

The parameter E relates to the degree of texturizing that occurs to the face 25 of the object 20. The range of values is from "0" to "30." A "0" would be a face 25 that has no etch after texturizing. Conversely, a "30" would have very severe grooving with no uniform area. The preferred range for E is from 7 to 19. A "7" is the onset of significant texturizing of the face 25 of the object 20. A value of "20" is the first point that a groove will be apparent to the naked eye. Examples for values of E are illustrated below:

| | | |
|---|---|---|
| Frances B. DeMasi Schools<br>199 Evesboro-Medford Road<br>Evesham Twp., NJ<br>"E" Rating: 17–18 | Holy Name of Jesus Church<br>17 Earlington Avenue<br>Mullica Hill, NJ<br>"E" Rating: 14 | Giordono's Restaurant<br>633 E. Cypress Street<br>Nennett Square, PA<br>"E" Rating: 11 |

In each of these examples, E. P. Henry Corporation, 201 Park Avenue, Woodbury, N.J., 08096 supplied the concrete blocks. The concrete block mix number for each project is 10G, 500E, and 509F, respectively.

Different values of E produce different texturized appearances that may be appropriate for diverse applications. For example, an architect may desire concrete blocks having a both smaller and larger value of E to create different appearances in the same building.

In the method of the present invention, there can be one nozzle 23 or, alternatively, at least two nozzles 23. The preferred distance to locate the discharge end 22 of each nozzle 23 from the face 25 of the object 20 is 30 to 60 inches for a number 8 long venturi nozzle. For a larger nozzle 23, the distance would be greater and the opposite for a smaller nozzle 23. Distances of 12 inches or greater from the target are desirable.

Each nozzle 23 can be adjustably mounted to frame 12 by any conventional means. One example is shown in FIG. 2 wherein a horizonal arm 26 and a vertical arm 28, each of which have a plurality of openings 30,32 respectively therethrough. A pin is received through a selected opening which sets the horizontal and vertical position of nozzle 23 with respect to the face 25 of the object 20.

Multiple nozzles 23 allow a greater area to be texturized in a single pass. In the method of the present invention, the discharge ends 22 of the nozzles 23 are mounted in a vertical plane perpendicular to the relative movement of a selected one of the face 25 of the object 20 or the discharge end 22 of the nozzles 23 in front of the other. Thus, the preferred embodiment has the discharge end 22 of the nozzle 23 perpendicular to the face 25 of the object 20. It is possible to have the nozzle 23 offset at an angle from perpendicular. Angles of up to 60° have been tested with satisfactory results. However, the greater the offset is from perpendicular to the face 25 of the object 20, the less efficient the operation because much of the energy of the blast media is not directed at the face 25 of the object 20.

In the concrete industry, pavers are produced that measure 12 inches by 12 inches or 16 inches by 16 inches on their face 25. If one attempted to texturize these products with a single nozzle 23, as Balhorn teaches, the discharge end 22 of the nozzle 23 would have to be an extraordinary distance from the face 25 of the object 20, thus requiring an extremely high pressure. The present invention alleviates this drawback by its use of multiple nozzles 23 for a single pass.

If there are two or more nozzles 23, it is preferable that the nozzles 23 be the same type, the same size, and equidistance from the face 25 of the object 20. The discharge ends 22 of the nozzles 23 can be mounted in a vertical plane perpendicular to the relative movement of a selected one of the face 25 of the object 20 or the discharge end 22 of the nozzles 23 in front of the other. As such, the nozzles 23 can be vertically disposed relative to each other.

Preferably, the vertical distance separating each nozzle 23 is calculated by the equation $$S=(1.4)(U)+1.2,$$

wherein S is the vertical spacing between centerlines of the discharge ends 22 of each nozzle 23 in inches and U is the width of the uniform etch created on the face 25 of an object 20 for each nozzle 23 in inches. A value of U can be approximated by the equation $$U=(0.081)(D),$$

wherein D is the distance from the front of the nozzle 23 to the target in inches. While the equation $$S=(1.4)(U)+1.2$$

approximates maximum efficiency, a smaller value of S can also be used.

It is not necessary to align the nozzles 23 in the vertical plane. Instead, the separation of importance is that perpendicular to the direction of relative motion between the face 25 of the object 20 and the discharge end 22 of the nozzles 23. In addition, the nozzles 23 do not need to be directly over each other but can be off-set.

It is also contemplated that a single nozzle 23 could be used for one pass and then repositioned perpendicular to the direction of relative motion between the nozzle 23 and the object 20, preferably at a distance calculated by the equation $$S=(1.4)(U)+1.2.$$

The discharge end 22 of the nozzle 23 preferably can be located at the same predetermined distance from the face 25 of the object 20. The object 20 then could be sent through a subsequent pass. This process can be repeated until the entire face 25 of the object 20 has been texturized by a single nozzle 23.

The method of the present invention can further comprise, prior to the moving step, the step of adjusting the position of the discharge end 22 of one nozzle 23 with respect to the discharge end 22 of the other nozzle 23.

EXAMPLES

As discussed above, the following relationship was determined by trial and error tests as the equation:

$$F=(E+10)(D)^{0.5}(R)(N^2)(P).$$

Once F has been determined for the object and the desired E approximated, then the operating conditions can be determined by solving the equation for the variables D, R, N, and P. It has been determined that when appropriate combinations of values for D, R, N, and P are used to keep E in the range of 7 to 19, U can be approximated by the equation $$U=(0.081)(D).$$

Recognizing the limitations imposed by experimental error, this equation is a good approximation for starting a production run.

For example, if one desired to produce an object with a 5 inch uniform width, e.g. U=5 inches, with a single nozzle, then D would be 62 inches. Specifically, $$D=(U)/(0.081)=(5)/(0.081)=62.$$

With a D of 62 and if the desired E was 12, F was 9, the nozzle was a number 5 nozzle, and the blasting unit could maintain a pressure of 60 psig, then the required speed could be determined. Solving for R, the equation can be rewritten as $$R=(F)(N)_2(P)/(E+10)(D)^{0.5}.$$

Substituting values into the equation yields:

$$R=(9)(5)_2(60)/(12+10)(63)^{0.5}=78.$$

Thus, a speed of the object of 78 inches per minute would result. Fine tuning could be done if desired or needed. Importantly, these conditions are very different from what are typically used in sandblasting operations.

One advantage of the present invention can be illustrated by solving the equation for conventional concrete blocks which measure 7 ⅝ inches in height. Thus, an appropriate value of U would be 8 inches. Using a single number 8 nozzle, a distance of 98 inches, a pressure of 60 psig, a desired E of 12, and F of 9, a speed of approximately 185 inches per minute could be used. This provides a production rate for texturizing concrete blocks of 610 per hour. For similar coverage, the method and apparatus taught by Balhorn would be approximately 520 units per hour. This differential, an increase of over 15%, demonstrates an important advantage of the present invention.

Test also were conducted with multiple nozzle operations. It was originally anticipated that the spacing, S, between nozzles 23 would be the same as U, the width of apparent uniform etch on the face of the object. As discussed above, it was experimentally determined that $$S=(1.4)(U)+1.2,$$

where S is the widest separation in which no light center line results. Consequently, two nozzles 23 will provide approximately 125% more coverage than anticipated. Similarly, three nozzles 23 provide 133% and four nozzles 137% more coverage than anticipated. These results occurred because the over-spray of each nozzle—which is the lighter etch further out than the width designated as U—overlap sufficiently to combine and satisfactorily etch the face of the object. Conversely, if the two nozzles are brought closer together, then the overlap causes the area between the two nozzles to become more heavily etched than a single nozzle.

Although the present process has been described with reference to specific details of certain embodiments thereof, it is not intended that such details should be regarded as limitations upon the scope of the invention except as and to the extent that they are included in the accompanying claims.

What I claim is:

1. A method of uniformly texturizing an object having at least one face, comprising the steps of:

a. calculating a placement distance to dispose the discharge end of at least one sandblasting nozzle from the face of the object based on the relative speed of movement of either one of the object or the nozzle, the size of the nozzle, the air pressure feeding particles through the discharge end of the nozzle, the material composition of the object, and the desired appearance of the face of the object after texturizing;

b. disposing the discharge end of the nozzle at the placement distance;

c. moving a selected one of the face of the object or the discharge end of the nozzle in front of the other; and d. subjecting the face of the object to a spray of particles from the discharge end of the nozzle generated by air pressure at a selected particle feed rate so as to uniformly texturize the face of the object to obtain the desired appearance, wherein the calculating step utilizes the equation $F=(E+10)(D)^{0.5}(R)(N)^2(P)$ to calculate the placement distance, D, wherein P is the pressure of the air carrying the blast media, N is the size of the nozzle, R is the speed of movement of either one of the object or the nozzle relative to the other, F is a constant based on the materials from which the object is constructed, and E is a rating for the desired appearance of the texturized face.

2. The method of claim 1, wherein the discharge ends of the nozzles are mounted in a vertical plane perpendicular to the relative movement of a selected one of the face of the object or the discharge end of the nozzles in front of the other.

3. The method of claim 1, wherein there is one nozzle.

4. The method of claim 1, wherein there are at least two nozzles.

5. The method of claim 4, wherein the nozzles are the same size and the same type.

6. The method of claim 5, wherein the discharge ends of the nozzles are mounted in a vertical plane perpendicular to the relative movement of a selected one of the face of the object or the discharge end of the nozzles in front of the other.

7. The method of claim 6, wherein the nozzles are vertically disposed relative to each other.

8. The method of claim 7, wherein the maximum vertical distance separating each nozzle is calculated by the equation $S=(1.4)(U)+1.2$, wherein S is the vertical spacing between centerlines of the discharge ends of each nozzle and U is the width of the uniform etch created on the face of an object for each nozzle.

9. The method of claim 4, wherein the discharge ends of the nozzles are mounted equidistance from the face of the object.

10. The method of claim 4, further comprising, prior to the moving step, the step of adjusting the position of the discharge end of one nozzle with respect to the discharge end of the other nozzle.

11. A sandblasting unit for uniformly texturizing a face of an object comprising:

a. at least one sandblasting nozzle having a diameter therein and a discharge end disposed at a placement distance from the face of the object, wherein the placement distance is established based on the relative speed of movement of either the object or the nozzle, the size of the nozzle, the sandblasting force emitted from the discharge end of the nozzle, the material composition of the object, and the desired appearance of the face of the object after texturizing;

b. means for moving a selected one of the object or the nozzle in front of the other; and c. plurality of particles operatively connected to the nozzle, wherein the particles are emitted from the nozzle at a particle feed rate for a predetermined air pressure, whereby the face of the object is subjected to a spray of particles from the nozzle to obtain the desired appearance, wherein the placement distance is established by the equation $F=(E+10)(D)^{0.5}(R)/(N)^2(P)$, wherein P is pressure of the air carrying the blast media, N is the size of the nozzle, R is the speed of movement of either one of the object or the nozzle relative to the other, F is a constant based on the materials from which the object is constructed, and E is a rating for the desired appearance of the texturized face.

12. The apparatus of claim 11, wherein the moving means is a conveyor for the object.

13. The apparatus of claim 11, wherein there is one nozzle.

14. The apparatus of claim 13, further comprising means for moving the nozzle to a position at a vertically different elevation.

15. The apparatus of claim 11, wherein there are at least two nozzles.

16. The apparatus of claim 15, wherein the nozzles are the same size and the same type.

17. The apparatus of claim 16, wherein the discharge ends of the nozzles are mounted in a vertical plane perpendicular to the relative movement of a selected one of the face of the object or the discharge end of the nozzles in front of the other.

18. The apparatus of claim 17, wherein the maximum vertical distance separating each nozzle is calculated by the equation $S=(1.4)(U)+1.2$, wherein S is the vertical spacing between centerlines of the discharge ends of each nozzle and U is the width of the uniform etch created on the face of an object for each nozzle.

19. The apparatus of claim 16, wherein the nozzles are disposed equidistance from the face of the object.

20. The apparatus of claim 15, further comprising means for moving the discharge end of each nozzle with respect to the discharge end of the other nozzle.

21. The apparatus of claim 15, further comprising means for moving each nozzle to a position at a vertically different elevation.

22. A method of uniformly texturizing an object having at least one face, comprising the steps of:

a. calculating a placement distance to dispose the discharge end of at least one sandblasting nozzle from the face of the object based on the relative speed of movement of either one of the object or the nozzle, the size of the nozzle, the air pressure feeding particles through the discharge end of the nozzle, the material composition of the object, and the desired appearance of the face of the object after texturizing;

b. disposing the discharge end of the nozzle at the placement distance;

c. moving a selected one of the face of the object or the discharge end of the nozzle in front of the other; and d. subjecting the face of the object to a spray of particles from the discharge end of the nozzle generated by air pressure at a selected particle feed rate so as to uniformly texturize the face of the object to obtain the desired appearance, wherein there are at least two nozzles, the nozzles being the same size and the same type, wherein the discharge ends of the nozzles are mounted in a vertical plane perpendicular to the relative movement of a selected one of the face of the object or the discharge end of the nozzles in front of the other, wherein the nozzles are vertically disposed relative to each other, and wherein the maximum vertical distance separating each nozzle is calculated by the equation $S=(1.4)(U)+1.2$, wherein S is the vertical spacing between centerlines of the discharge ends of each nozzle and U is the width of the uniform etch created on the face of an object for each nozzle.

23. A sandblasting unit for uniformly texturizing a face of an object comprising:

a. at least one sandblasting nozzle having a diameter therein and a discharge end disposed at a placement distance from the face of the object, wherein the placement distance is established based on the relative speed of movement of either the object or the nozzle, the size of the nozzle, the sandblasting force emitted from the discharge end of the nozzle, the material composition of the object, and the desired appearance of the face of the object after texturizing;

b. means for moving a selected one of the object or the nozzle in front of the other; and c. a plurality of particles operatively connected to the nozzle, wherein the particles are emitted from the nozzle at a particle feed rate for a predetermined air pressure, whereby the face of the object is subjected to a spray of particles from the nozzle to obtain the desired appearance, wherein there are at least two nozzles, the nozzles being the same size and the same type, wherein the discharge ends of the nozzles are mounted in a vertical plane perpendicular to the relative movement of a selected one of the face of the object or the discharge end of the nozzles in front of the other, and wherein the maximum vertical distance separating each nozzle is calculated by the equation $S=(1.4)(U)+1.2$, wherein S is the vertical spacing between centerlines of the discharge ends of each nozzle and U is the width of the uniform etch created on the face of an object for each nozzle.

* * * * *